US009552946B2

(12) United States Patent
Ryu

(10) Patent No.: US 9,552,946 B2
(45) Date of Patent: Jan. 24, 2017

(54) VACUUM INTERRUPTER

(71) Applicant: LSIS CO., LTD., Anyang-si, Gyeonggi-do (KR)

(72) Inventor: Jaeseop Ryu, Anyang-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/981,613

(22) Filed: Dec. 28, 2015

(65) Prior Publication Data

US 2016/0247649 A1 Aug. 25, 2016

(30) Foreign Application Priority Data

Feb. 23, 2015 (KR) ..... 10-2015-0025349

(51) Int. Cl.
*H01H 33/662* (2006.01)

(52) U.S. Cl.
CPC . *H01H 33/66238* (2013.01); *H01H 33/66207* (2013.01); *H01H 2033/66246* (2013.01); *H01H 2033/66253* (2013.01); *H01H 2223/002* (2013.01)

(58) Field of Classification Search
CPC ..... H01H 33/666; H01H 33/66207; H01H 33/6661; H01H 33/6662; H01H 9/0038; H01H 33/66; H01H 2033/6623; H01H 33/6606; H01H 9/0027; H01H 2033/66269; H01H 2033/6665; H01H 33/66261; H01H 33/664
See application file for complete search history.

(56) References Cited

U.S. PATENT DOCUMENTS 4,733,456 A * 3/1988 Sofianek ..... H01H 33/66261 228/138
4,933,518 A * 6/1990 Yin ..... H01H 33/66207 218/134
6,043,446 A * 3/2000 Mayo ..... H01H 33/66207 218/134
2007/0090095 A1* 4/2007 Yoshida ..... H01H 33/66207 218/118
2008/0203063 A1* 8/2008 Dullni ..... H01H 33/66261 218/136
2008/0302763 A1* 12/2008 Stoving ..... H01H 33/66261 218/124
2010/0032412 A1* 2/2010 Trondsen ..... H01H 33/66261 218/136

(Continued)

FOREIGN PATENT DOCUMENTS

DE 2440829 3/1976
DE 60124601 9/2007

(Continued)

OTHER PUBLICATIONS

Korean Intellectual Property Office Application No. 10-2015-0025349, Office Action dated Jun. 13, 2016, 4 pages.

(Continued)

*Primary Examiner* — Truc Nguyen
(74) *Attorney, Agent, or Firm* — Lee, Hong, Degerman, Kang & Waimey PC

(57) ABSTRACT

The present disclosure relates to a vacuum interrupter, and particularly, to a vacuum interrupter having enhanced performance of discharging air from the interior of a bellows in a breaking operation.

5 Claims, 6 Drawing Sheets

(56) References Cited

U.S. PATENT DOCUMENTS

| | | | | |
|---|---|---|---|---|
| 2010/0172064 | A1* | 7/2010 | Takahashi | H01G 5/014 361/296 |
| 2010/0230388 | A1* | 9/2010 | Tak | H01H 33/6644 218/123 |
| 2010/0270267 | A1* | 10/2010 | Noda | C22C 9/00 218/123 |

FOREIGN PATENT DOCUMENTS

| | | |
|---|---|---|
| EP | 1120803 | 8/2001 |
| JP | S5963626 | 4/1984 |
| KR | 1020050106325 | 11/2005 |
| WO | 2013171928 | 11/2013 |

OTHER PUBLICATIONS

European Patent Office Application No. 15203034.2, Search Report dated Jun. 14, 2016, 26 pages.

* cited by examiner

VACUUM INTERRUPTER

CROSS-REFERENCE TO RELATED APPLICATION

Pursuant to 35 U.S.C. §119(a), this application claims the benefit of earlier filing date and right of priority to Korean Patent Application No. 10-2015-0025349, filed on Feb. 23, 2015, the contents of which are incorporated by reference herein in its entirety.

BACKGROUND OF THE DISCLOSURE

1. Field of the Disclosure

The present disclosure relates to a vacuum interrupter, and particularly, to a vacuum interrupter having enhanced performance of discharging air from the interior of a bellows in a breaking operation.

2. Background of the Disclosure

In general, a vacuum circuit breaker is a sort of circuit breaker is installed in a high voltage electric power system to break a circuit in a dangerous situation such as a short circuit or an overcurrent to protect the electric power system, which is designed by utilizing the fact that the vacuum circuit breaker has excellent insulating properties and arc extinguishing capability.

In the vacuum circuit breaker, a core component is a vacuum interrupter which performs a function of electrically connect a circuit or breaking the circuit within a hermetically sealed vacuum tube. The vacuum circuit breaker includes a fixed electrode and a movable electrode that can be brought into contact with the fixed electrode or separated from the fixed electrode. In particular, portions where the fixed electrode and the movable electrode are directly in contact with each other are called a fixed contact and a movable contact.

Here, in particular, since the movable electrode makes a linear movement so as to be brought into contact with the fixed electrode or separated from the fixed electrode, while the interior of the vacuum interrupter is maintained in a vacuum state, a bellows is installed around the movable electrode.

The interior of the vacuum interrupter is in a vacuum state, and atmospheric pressure or gas pressure is applied to the interior of the bellows. Since pressure of the gas applied to the interior of the bellows greatly affects operation characteristics of the vacuum interrupter, an influence of gas pressure should be taken into consideration in designing a manipulator or determining capacity. When gas pressures is increased, a self-closing force of the vacuum interrupter is increased to cause an increase in a speed in a closing operation and cause a decrease in a speed in a breaking operation, and thus, performance of the manipulator should be increased.

FIG. 1 illustrates an internal structure of a vacuum interrupter according to a related art. In the vacuum interrupter 100 according to the related art, a fixed contact 1, a fixed electrode 2, a movable contact 3, a movable electrode 5, a bellows 6, and a bellows guide 7 are installed within an enclosure formed of a ceramic container 5, an upper fixing unit flange 8, and a lower moving unit flange 9. Here, the interior of the enclosure is maintained in a vacuum state.

The fixed contact 1 and the fixed electrode 2 connecting the fixed contact 1 to a power source or a load outside of the vacuum interrupter 100 are connected to each other, and the fixed electrode 2 is connected such that it is sealed by the fixing unit flange 8.

The movable contact 3 facing the fixed contact 1 is connected to the movable electrode 4, and the movable electrode 4 is connected to a load or a power source outside of the vacuum interrupter 100. Here, the bellows 6 is installed on the movable contact 4 such that the bellows 6 can be freely moved while maintaining the vacuum state inside the vacuum interrupter 100.

The bellows guide 7 is installed between the movable electrode 4 and the bellows 6 and is fixed to be installed in the moving unit flange 9. The bellows guide 7 assists the movable electrode 4 to make a reciprocal linear movement, prevents the movable electrode 4 from being shaken to the side when making a linear movement, and enables air or a gas inside A the bellows to be discharged to the outside.

FIG. 2 illustrates a detailed structure of the bellows guide 7 according to the related art. An inner surface 7*a* of the bellows guide 7 is in contact with an outer surface of the movable electrode 4, and an outer surface 7*b* of the bellows guide 7 is installed to face an inner side of the bellows 6. Also, a protrusion 7*c* of the bellows guide 7 is inserted into a groove (not shown) of the movable electrode 4, guides the movable electrode 4 to make a linear movement, and is provided to prevent the movable electrode 4 from staggering to deform and damage the bellows 6.

When the vacuum interrupter 100 performs a breaking operation, the bellows 6 is compressed, and here, the groove 7*d* formed inside of the bellows guide 7 functions as an exit for discharging air or a gas inside A of the bellows 6 to the outside.

In the vacuum interrupter 100 according to the related art, when the bellows 6 performs a breaking operation, air or a gas inside A of the bellows 6 is discharged to the outside through the groove 7*d* formed in a length direction inside of the bellows guide 7.

However, when a breaking speed is fast or a gas pressure inside A of the s bellows 6 is increased, the exit of the groove 7*d* cannot tolerate an amount of outflow gas which is rapidly expanded, to result in an incomplete operation or to become slow in a breaking speed. In addition, since the groove 7*d* is formed in a narrow space between the bellows guide 7 and the movable electrode 4, there is a limitation in securing a sufficient space.

SUMMARY OF THE DISCLOSURE

Therefore, an aspect of the detailed description is to provide a vacuum interrupter having enhanced performance of discharging air from the interior of a is bellows in a breaking operation.

To achieve these and other advantages and in accordance with the purpose of this specification, as embodied and broadly described herein, a vacuum interrupter includes: a container formed of an insulating material; a fixed portion end plate coupled to an upper portion of the container; a movable portion end plate coupled to a lower end portion of the container and having an opening hole formed in a central portion thereof; a movable electrode inserted into the opening hole and configured to be moved up and down; a bellows having one end installed in the movable portion end plate and the other end installed in the movable electrode within the container such that the interior of the container is maintained in a vacuum state even through the movable electrode moves; a bellows guide formed as a flange type tube body and having a flange portion coupled to the movable portion end plate and a body portion inserted into the opening hole and assist the movable electrode to make a linear movement; and a bellows guide fixing member formed as a tube body and coupled to a lower portion of the movable portion end plate to surround the flange portion, wherein a plurality of first side holes are formed in the flange portion, and a second side hole communicating with the plurality of first side holes is formed in the bellows guide fixing member to allow air inside the bellows to be discharged to the outside.

Here, a step may be formed on an inner circumferential surface of the bellows guide fixing member to fix the bellows guide.

Also, a guide protrusion portion may be formed on an inner circumferential surface of the bellows guide in a length direction to assist a linear movement of the movable electrode.

Also, a flange may be formed on an upper surface of the bellows guide fixing member to increase an area contacting with a lower portion of the movable portion end plate.

A first cutout portion formed as a plane surface may be formed on an outer circumferential surface of the flange portion, and a second cutout portion may be formed to be in face-contact with the first cutout portion on an inner circumferential surface of the bellows guide fixing member to prevent the bellows guide from being rotated or twisted.

In the vacuum interrupter according to an embodiment of the present disclosure, since an outflow amount of a gas discharged to the outside from the inner side per unit time when the bellows is compressed is increased, a defective operation such as generation of vibrations or a reduction in a breaking speed does not occur.

Also, the bellows guide is fixedly coupled to a lower portion of the movable portion end plate by the bellows guide fixing member.

In addition, the bellows guide may not be rotated or twisted within the bellows guide fixing member but may be stably maintained in position.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of the exemplary embodiments, with reference to the accompanying drawings. For the sake of brief description to with reference to the drawings, the same or equivalent components will be provided with the same reference numbers, and description thereof will not be repeated.

Hereinafter, exemplary embodiments of the present disclosure will be described in detail with reference to the accompanying drawings so that a is person skilled in the art to which the present invention pertains to easily implement the invention, but the present invention is not limited thereto.

Figure 1:
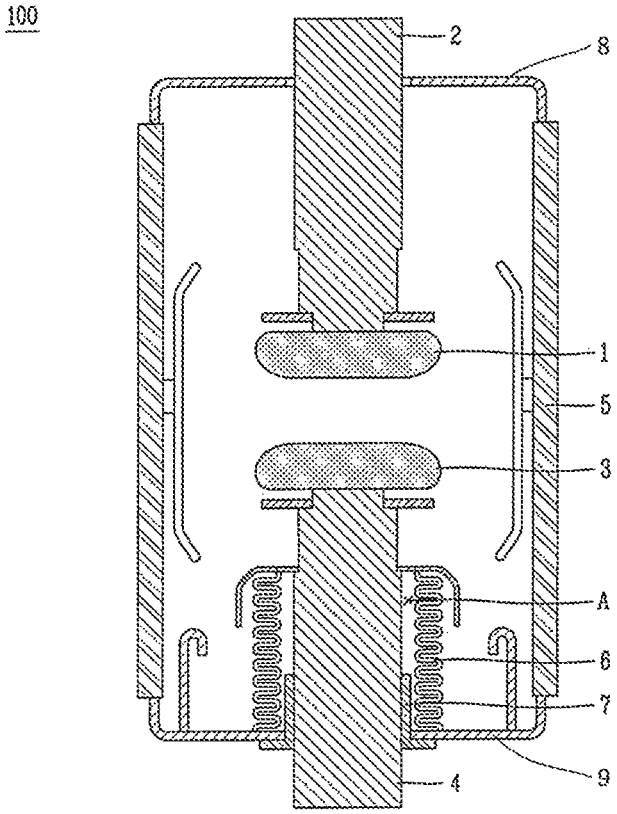
FIG. 1 Prior Art
FIG. 1 is a vertical sectional view of a vacuum interrupter according to the related art.
Figure 2:
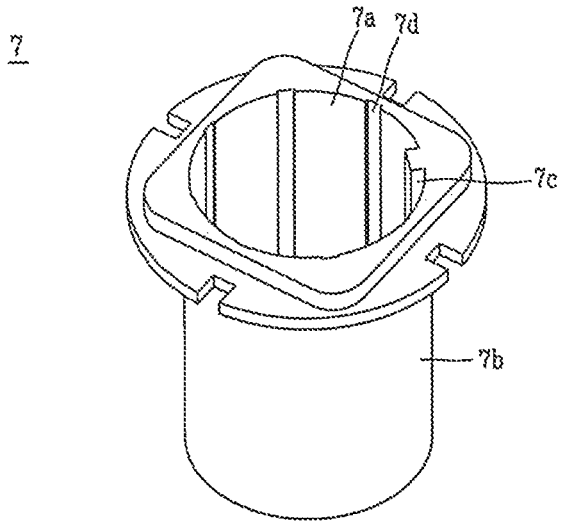
FIG. 2 Prior Art
FIG. 2 is a perspective view of a bellows guide of FIG. 1.
Figure 3:
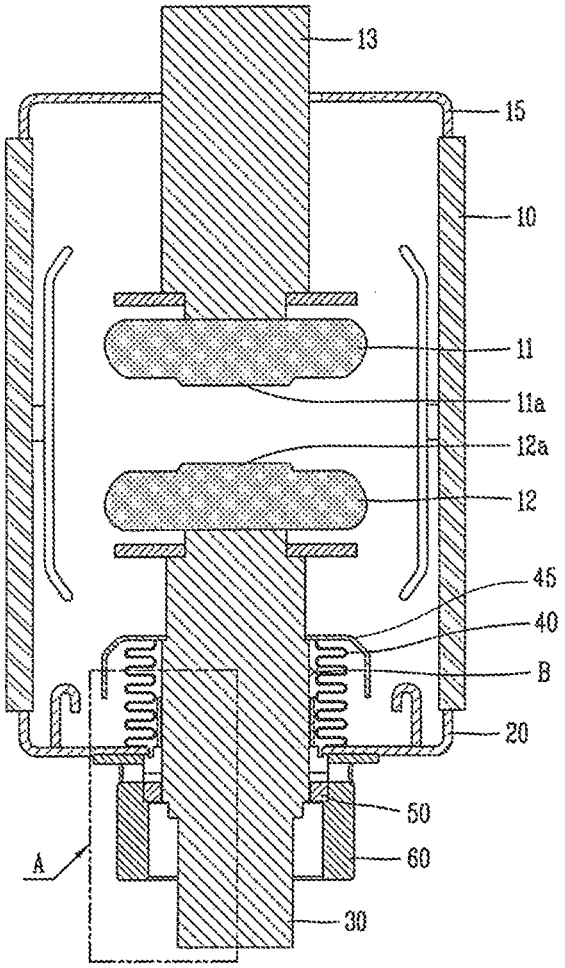
FIG. 3 is a vertical sectional view of a vacuum interrupter according to an embodiment of the present disclosure.
Figure 4:
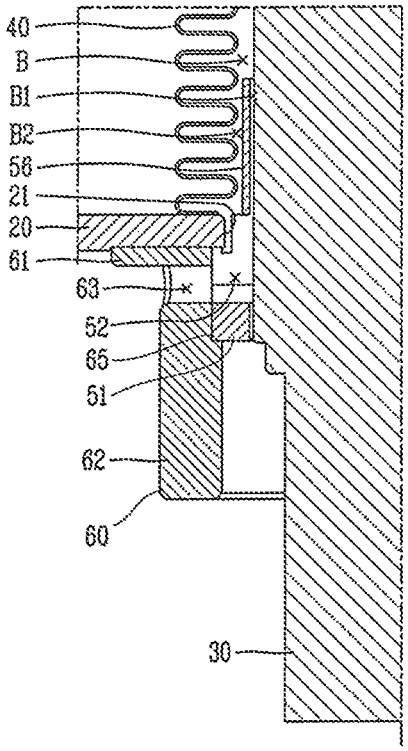
FIG. 4 is a detailed view of portion 'A' of FIG. 3.
Figure 5:
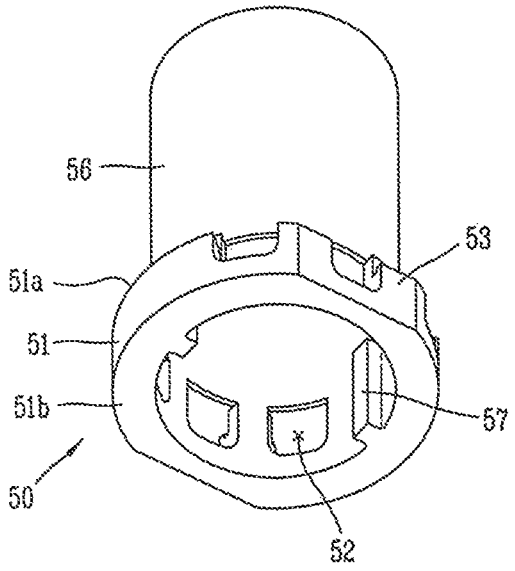
FIG. 5 is a perspective view of a bellows guide of FIG. 3.
Figure 6:
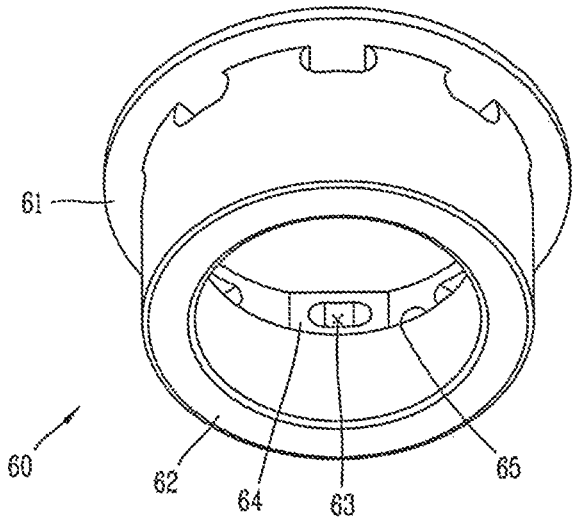
FIG. 6 is a perspective view of a bellows guide fixing member of FIG. 3.

FIG. 3 is a vertical sectional view of a vacuum interrupter according to an embodiment of the present disclosure. FIG. 4 is a detailed view of portion 'A' of FIG. 3. FIG. 5 is a perspective view of a bellows guide of FIG. 3. FIG. 6 is a perspective view of a bellows guide fixing member of FIG. 3. Embodiments of the present disclosure will be described in detail with reference to the accompanying drawings.

The vacuum interrupter according to an embodiment of the present disclosure includes a container 10 formed of an insulating material; a fixed portion end plate 15 coupled to an upper end portion of the container 10; a movable portion end plate 20 coupled to a lower end portion of the container 10 and having an opening hole 21 formed in a central portion thereof; a movable electrode 30 inserted into the opening hole 21 and moved up and down; a bellows 40 having one end installed in the movable portion end plate 20 and the other end installed in the movable electrode 30 within the container to maintain a vacuum state within the container even though the movable electrode 30 moves; a bellows guide 50 formed as a flange type tube body and having a flange portion 51 coupled to the movable portion end plate 20 and a body portion 56 inserted into the opening hole 21 to allow the movable electrode 30 to make a linear movement; and a bellows guide fixing member 60 formed as a tube body and installed below the movable portion end plate 20 to surround the flange portion 51, wherein a plurality of first side holes 52 are formed in the flange portion 51 and a second side hole 63 communicating with the first side holes 52 is formed in the bellows guide fixing member 60 to allow air between the bellows 40 and the movable electrode to be discharged to the outside.

The container 10 forms an outer appearance of a side portion of the vacuum interrupter. The container 10 may have a cylindrical shape and formed of an insulating material. As the insulating material, ceramic, or the like, may be used. According to embodiments, the container 10 may be divided into an upper container and a lower container. The fixed contact 11 and the moving contact 12 are accommodated within the container 10.

The fixed contact 11 has a disk shape and coupled to the fixed electrode 13 so as to be connected to a power source side or a load side. The fixed contact 11 may be formed of chromium copper (Cu—Cr). A fixed contact point may be formed to protrude from an end portion of the fixed contact 11.

The movable contact 12 may be formed to have a disk shape, like the fixed contact 11, and coupled to the movable electrode 30 so as to be connected to the load side or the power source side. Since the movable contact 12 is coupled to the movable electrode 30, the movable contact 12 may be driven up and down by a driving unit (not shown). The movable contact 12 may be formed of chromium copper (Cu—Cr).

A movable contact point 12*a* may be formed to protrude from an end portion of the movable contact 12.

The movable contact 12 may be moved by the driving unit so as to be brought into contact with the fixed contact 11 or separated from the fixed contact 11. When the movable contact 12 is brought into contact with the fixed contact 11, a current may flow from the power source side to the load side, and when a breaking operation is performed in the vacuum circuit breaker due to a fault current, or the like, the movable contact 12 is separated from the fixed contact 11 and the current transmitted from the power source side to the load side may be cut off.

The fixed portion end plate 15 is coupled to an upper end portion of the container 10, and the movable portion end plate 20 is coupled to a lower end portion of the container 10. The vacuum interrupter forms a hermetically closed space by the container 10, the fixed portion end plate 15, and the movable portion end plate 20. The interior of the hermetically closed space is maintained in a vacuum state.

An opening hole 21 is formed in a central portion of the movable portion end plate 20, into which the movable electrode 30 and the bellows guide 50 may be inserted.

The movable contact 12 may be connected to one end portion of the movable electrode 30, and the other end portion of the movable electrode 30 is connected to the driving unit (not shown). The movable electrode 30 moves up and down upon receiving driving power from the driving unit to bring the movable contact 12 into contact with the fixed contact 11 or separate the movable contact 12 from the fixed contact 11.

The bellows 40 is installed around the movable contact 30. One end of the bellows 40 is fixedly coupled to the movable portion end plate 20, and the other end of the bellows 40 is coupled to the movable electrode 30 so as to be to moved together with the movable electrode 30. Vacuum closeness characteristics of the interior of the vacuum interrupter may be maintained by the bellows 40. That is, even though vacuum between the movable electrode 30 and the movable portion end plate 20 is broken according to a movement of the movable electrode 30, since it is shielded by the bellows 40, the interior of the is vacuum interrupter may be maintained in the vacuum state.

A shield 45 may be installed around the bellows 40. The shield 45 may protect the bellows 40 from metal steam generated in a breaking operation.

The bellows guide 50 is inserted to be installed in the opening hole 21 of the movable portion end plate 20. The bellows guide 50 may be formed as a flange type tube body. That is, the bellows guide 50 may include the flange portion 51 and the body portion 56.

The flange portion 51 and the body portion 56 may be formed to have a single inner circumferential surface. The flange portion 51 may be installed to be in contact with a lower portion of an end portion of the movable portion end plate 20 where the opening hole 21 is formed. The body portion 56 may be installed to be inserted into the opening hole 21 and surround the movable electrode 30.

A guide protrusion portion 57 may be on an inner circumferential surface of the bellows guide 50 in a length direction. A recess portion (not shown) engaged with the guide protrusion portion 57 may be formed on the movable electrode 30 to maintain a linear movement of the guide protrusion portion 57.

A plurality of first side holes 52 are formed on the flange portion 51. The first side holes 52 may be formed to extend to a portion of the body portion 56. Thus, air of a gas present inside B of the bellows 40 may be discharge to the outside through the first side holes 52 through a space B1 between the bellows guide 50 and the movable electrode 30 and may move to the interior or to the outside through the first side holes 52 through a space B2 between the bellows 40 and the bellows guide 50. That is, air present inside the bellows 40 may be discharged to the outside by the bellows 40 compressed by the movable electrode 30 rapidly moving when a breaking operation is performed, and at this time, since air flows through the space B1 between the bellows guide 50 and the movable electrode 30 and the space B2 between the bellows 40 and the bellows guide 50 and is charged through the first side holes 52, a rapid increase in an outflow amount per unit time may be effectively handled. Thus, instability of an operation such as vibration, or the like, generated when air cannot be properly discharged can be prevented. If air inside the bellows 40 is not properly discharged in a breaking operation, a movement of the movable electrode 30 may be interfered by self-closing force due to a difference between external atmospheric pressure and vacuum pressure inside the vacuum interrupter, which may cause a defective operation or a reduction in a breaking speed.

A first cutout portion 53 may be formed in the flange portion 51 as a portion of an outer circumferential surface is cut out. The first cutout portion 53 may be in face-contact with a second cutout portion 64 formed on an inner circumferential surface of the bellows guide fixing member 60 as described hereinafter.

The bellows guide fixing member 60 is provided to fixedly support the bellows guide 50. The bellows guide fixing member 60 may be formed as a tube body.

A flange 61 having a plate shape may be formed on an upper portion of the bellows guide fixing member 60. The bellows guide fixing member 60 is inserted to surround the flange portion 51 of the bellows guide 50, and the flange 61 of the bellows guide fixing member 60 is coupled to the movable portion end plate 20. Here, the coupling method may be welding coupling to increase integration characteristics and coupling characteristics. Since an area in which the bellows guide fixing member 60 is in contact with the movable portion end plate 20 is increased by the flange 61, excellent coupling force may be obtained.

A step 65 may be formed on an inner circumferential surface of the bellows guide fixing member 60. The other end surface 51*b* of the flange portion 51 of the bellows guide 50 may be fixedly in contact with the step 65 of the bellows guide fixing member 60. That is, since one end surface 51*a* of the flange portion 51 is in contact with the movable portion end plate 20 and the other end surface 51 b of the flange portion 51 is fixedly in contact with the step 65 of the bellows guide fixing member 60, the bellows guide 50 may be maintained in position and is not released even without a separate coupling unit.

A second side hole 63 is formed in a position of the bellows guide fixing member 60 corresponding to the first side hole 52. Air inside the bellows 40 may flow to the outside through the first side hole 52 and the second side hole 63 of the bellows guide fixing member 60.

A second cutout portion 64 corresponding to the first cutout portion 53 of the bellows guide 50 is formed on an inner circumferential surface of the bellows guide fixing member 60. The first cutout portion 53 and the second cutout portion 64 may be in face-contact with each other. Here, the first cutout portion 53 and the second cutout portion 64 may be formed to be plane surface to each other. Since the first cutout portion 53 and the second cutout portion 64 are in face-contact with each other, the bellows guide 50 may not slide within the bellows guide fixing member 60. Thus, the bellows guide 50 is not rotated or twisted.

In the vacuum interrupter according to one embodiment of the present disclosure, since an outflow amount of a gas discharged to the outside from the inner side per unit time when the bellows is compressed is increased, a defective operation such as generation of vibrations or a reduction in a breaking speed does not occur. That is, since a passage for outflow of a gas within the bellows is secured through the space between the bellows guide and the bellows as well as through the space between the bellows guide and the movable electrode, an outflow amount per unit time is increased.

Also, the bellows guide is fixedly coupled to a lower portion of the movable portion end plate by the bellows guide fixing member.

In addition, the bellows guide may not be rotated or twisted within the bellows guide fixing member but may be stably maintained in position.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A vacuum interrupter comprising:

a container formed of an insulating material;

a fixed portion end plate coupled to an upper portion of the container;

a movable portion end plate coupled to a lower end portion of the container and having an opening hole formed in a central portion thereof;

a movable electrode inserted into the opening hole and configured to be moved up and down;

a bellows having one end installed in the movable portion end plate and the other end installed in the movable electrode within the container such that the interior of the container is maintained in a vacuum state even through the movable electrode moves;

a bellows guide formed as a flange type tube body and having a flange portion coupled to the movable portion end plate and a body portion inserted into the opening hole and assist the movable electrode to make a linear movement; and a bellows guide fixing member formed as a tube body and coupled to a lower portion of the movable portion end plate to surround the flange portion, wherein a plurality of first side holes are formed in the flange portion, and a second side hole communicating with the plurality of first side holes is formed in the bellows guide fixing member to allow air inside the bellows to be discharged to the outside.

2. The vacuum interrupter of claim 1, wherein a step is formed on an inner circumferential surface of the bellows guide fixing member to fix the bellows guide.

3. The vacuum interrupter of claim 1, wherein a guide protrusion portion is formed on an inner circumferential surface of the bellows guide in a length direction to assist a linear movement of the movable electrode.

4. The vacuum interrupter of claim 1, wherein a flange is formed on an upper surface of the bellows guide fixing member to increase an area contacting with a lower portion of the movable portion end plate.

5. The vacuum interrupter of claim 1, wherein a first cutout portion formed as a plane surface is formed on an outer circumferential surface of the flange portion, and a second cutout portion is formed to be in face-contact with the first cutout portion on an inner circumferential surface of the bellows guide fixing member to prevent the bellows guide from being rotated or twisted.

* * * * *